US006129820A

United States Patent [19]

Gheeraert et al.

[11] Patent Number: 6,129,820

[45] Date of Patent: Oct. 10, 2000

[54] ELECTROPLATING INSTALLATION, ELECTRODE AND SUPPORT DEVICE FOR THIS INSTALLATION AND ELECTROPLATING PROCESS

[75] Inventors: Philippe Gheeraert, Marck; Jean-Marie Vienne, Grande Synthe; Bernard Vandenbussche, Zegerscappel, all of France

[73] Assignee: Sollac, Puteaux, France

[21] Appl. No.: 09/204,545

[22] Filed: Dec. 3, 1998

[30] Foreign Application Priority Data

Dec. 3, 1997 [FR] France ..... 97 15179

[51] Int. Cl.[7] ..... C25C 7/00

[52] U.S. Cl. ..... 204/242; 204/286.1; 204/206; 204/280

[58] Field of Search ..... 204/280, 242, 204/286

[56] References Cited

U.S. PATENT DOCUMENTS

| | | | |
|---|---|---|---|
| 3,855,108 | 12/1974 | Boltz | 204/206 |
| 5,188,720 | 2/1993 | Colin et al. | 204/206 |
| 5,228,965 | 7/1993 | Ameen et al. | 204/206 |
| 5,944,965 | 8/1999 | Ameen et al. | 204/206 |

FOREIGN PATENT DOCUMENTS 0 140 474 5/1985 European Pat. Off. .

*Primary Examiner*—Kathryn Gorgos
*Assistant Examiner*—Erica Smith-Hicks
*Attorney, Agent, or Firm*—Oblon, Spivak, McClelland, Maier & Neustadt, P.C.

[57] ABSTRACT

An electroplating installation for coating the conducting surface of a part. The installation includes electrodes submerged in a bath. The electrodes rest on a support device that serves as a support and a current supply. The electrodes and the support device form an interface defining a plurality of grooves opening into the bath. The grooves may be formed in the electrodes, in the support device, or in both the electrodes and the support device.

15 Claims, 4 Drawing Sheets

ELECTROPLATING INSTALLATION, ELECTRODE AND SUPPORT DEVICE FOR THIS INSTALLATION AND ELECTROPLATING PROCESS

BACKGROUND OF THE INVENTION

1. Field of the Invention

The invention relates to a support device for submerged electrodes in the bath of an electroplating installation, and also to the current supply to these electrodes, particularly in the case of electrodes that are expendable, soluble anodes and that have to be exchanged during electroplating. An example of an installation of this type is an installation for zincplating steel strips in a chloride-based electrolytic bath.

2. Discussion of the Background

Cells are usually used as a zincplating installation for strips. These cells are typically referred to as "radial" cells. A shown in FIGS. 1–6, the cells may include mechanisms for passing the strip 100 to be coated through a bath 5. Such a mechanism may include, for example, a strip carrying roller 1 at least partially submerged under the surface level of the bath 5; support devices 2, 4 serving both as support for, and as current supply to, the submerged electrodes 3; and mechanisms for causing an electric current to flow between the strip 100 to be coated (serving as cathode) and the electrodes 3 (serving as anodes) on said support devices 2, 4. For zincplating strips in chloride medium, soluble anodes made of zinc or a zinc alloy are generally used.

The electrodes 3 (or soluble anodes) are formed of curved bars turned toward the roller 1 along the direction of travel of the strip 100. The electrodes 3 are also grouped in sets of electrodes 3 positioned side by side so as to form a cylindrical generator portion partially enveloping the roller 1 in the electroplating bath, as illustrated in FIGS. 1 and 2. The arrows shown in FIG. 4 illustrate how an electroplating electric current may flow.

As illustrated in FIGS. 1–3, each support device 2, 4 is common to all of the electrodes 3 of a corresponding set. In the example given in FIGS. 1–3, each support device 2, 4 is formed of a beam positioned transversally to the travel path of the strip 100 on which all the electrodes 3 of a given set rest. Each electrode 3 is held against the beams by an electrode hook 31.

The mechanical and electrical contact between an electrode 3 and its corresponding support device 2, 4 defines an interface 6 between a resting surface 6A of the electrode 3 and a corresponding bearing surface 6B of the support device (see FIGS. 5 and 6). Since the electrodes may be expendable (as in the case of soluble anodes), their thickness varies (see FIG. 3) according to the level of wear, and it may be necessary to change the electrodes 3 during electroplating as they dissolve. During electroplating, the electrodes 3 in the same set are slid along their corresponding support devices 2, 4 in the directions A and B respectively (see FIG. 3) in order to remove a worn electrode 3 at one end of the beam while creating a place for a new electrode 3 at the other end. To make the sliding of the electrodes 3 possible, each electrode 3 rests against its corresponding support device 2, 4 at the interface 6 only under the force of its own weight. Thus, the electrodes rest freely against their respective support device.

The support devices 2, 4 also serve to supply the electrodes 3 with electric current for electroplating. It has been noted that the electrical contact resistance at the interface 6 produces large energy losses. Given the weight of each electrode 3, the pressure exerted at the interface 6 on the support device generally does not exceed $10^4$Pa or 1 Newton per $cm^2$ of the bearing surface. During electroplating, the circulation of the bath 5 in the installation may cause this resting pressure to fall below 0.1 Newton per $cm^2$ of the bearing surface ($10^3$ Pa). As used herein, the term "bearing surface" means the total surface area at the interface 6 between the electrode 3 and the respective support device 2, 4.

Energy losses resulting from contact resistance at the interface 6 become particularly significant when the current density exceeds 0.025 $A/mm^2$ at the interface 6, particularly when the resting pressure is less than $10^4$ Pa, and even more so when the resting pressure is less than $10^3$ Pa. The increasing losses in energy appear to stem from a slight lifting of the anodes under the effect of the electric current, requiring the electric supply current of the electrodes 3 to pass in transit through the bath 5 interposed at the interface and causing gas emissions, e.g., emissions of chloride, at this location. This phenomenon is schematized in FIG. 6.

The beams that serve as the support devices 2, 4 are generally formed of resin-impregnated graphite. This material wears and deteriorates as a result of two phenomena: first, wear caused by the friction of the electrodes sliding on the beam; and second, fissuring due to heating and/or gas emissions caused by the electrical contact losses described above.

A graphite-based material which resists wear well is generally less resistant to fissuring and vice versa. Therefore, it is difficult to find a good compromise when choosing graphite material, and it remains necessary, regardless of this choice, to replace the beams regularly which represents a significant economic handicap.

SUMMARY OF THE INVENTION

Accordingly, an object of this invention is to reduce electrical contact losses at the interfaces between the support devices and electrodes of an electroplating installation.

It is another object of this invention to increase the useful lives of the support devices and the electrodes of an electroplating installation.

These and other objects of the present invention are achieved according to a novel apparatus and method in which an electrode and a support device form an interface. The interface forms a plurality of grooves that open into the bath. The grooves may be formed in the electrode, the support device, or both the electrode and the support device. The presence of the grooves in the interface increases current density and reduces the contact resistance at the interface. As a result, the useful lives of the support devices and the electrodes are extended.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
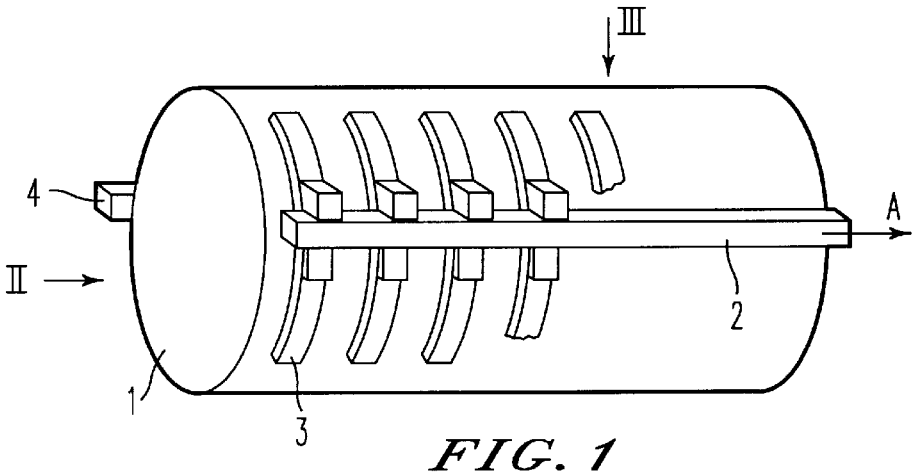
FIG. 1 shows a perspective view of a strip carrying roller 1.
Figure 2:
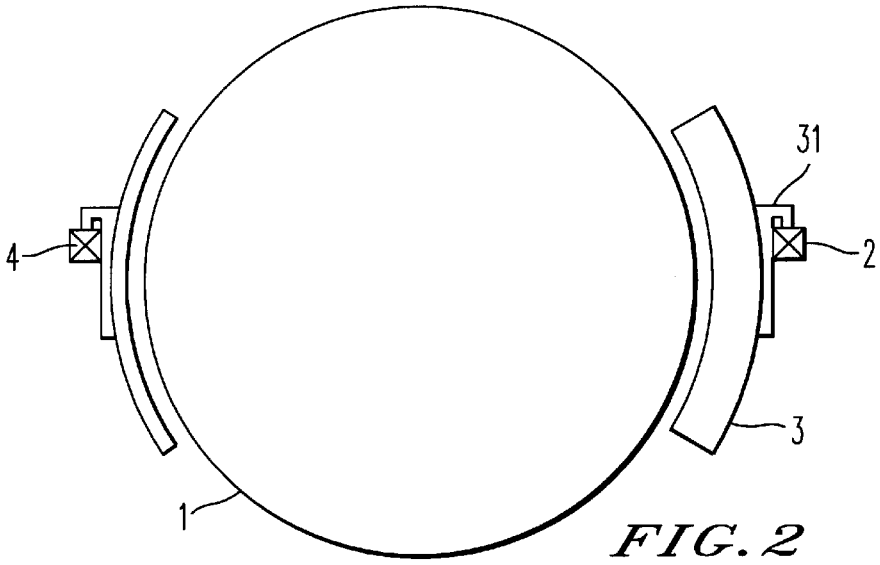
FIG. 2 shows a side view of the strip carrying roller 1 and the electrodes 3 of a radial cell.
Figure 3:
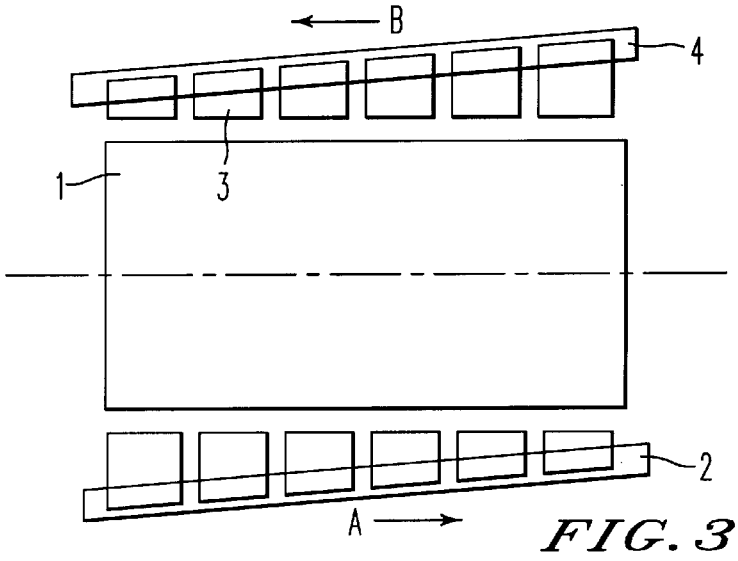
FIG. 3 shows a cross sectional view, taken along the plane of the axis of the roller 1, showing two sets of electrodes 3 on either side of the roller 1.
Figure 4:
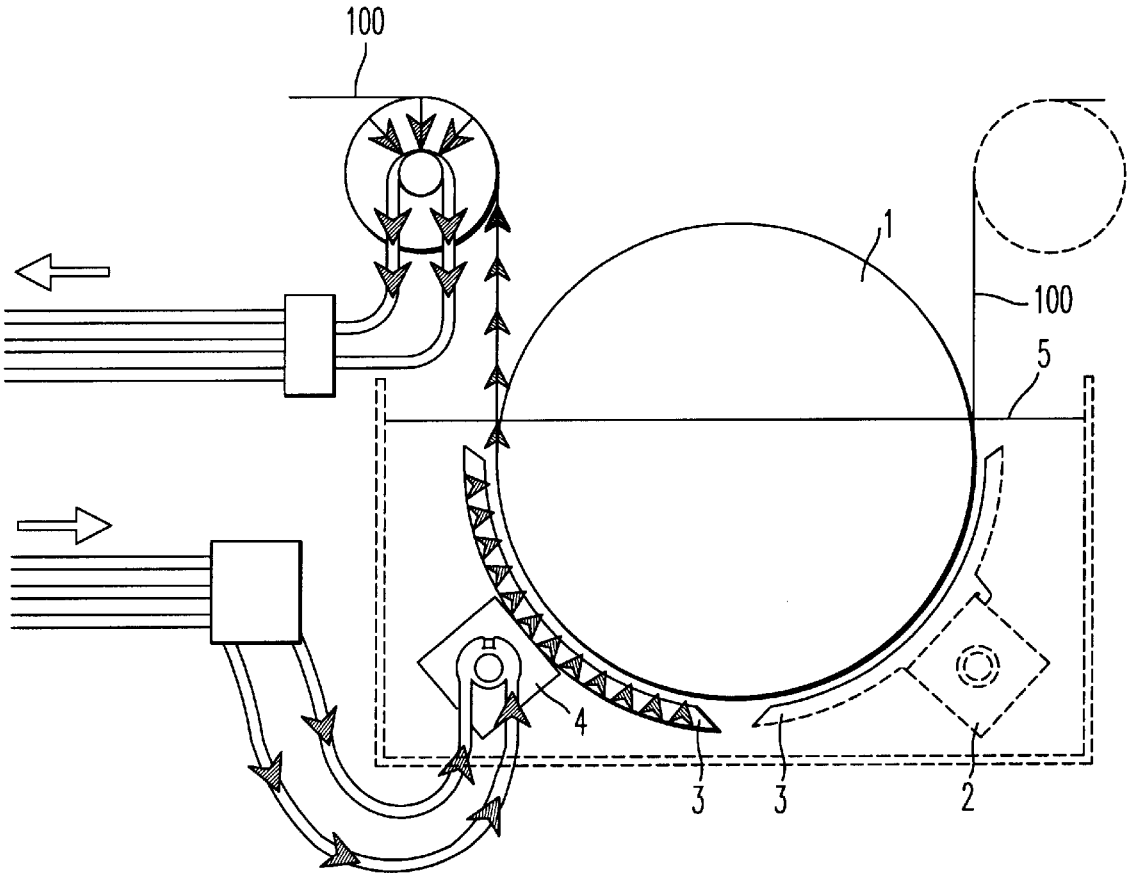
FIG. 4 shows a side view of a continuous strip electroplating installation (i.e., a radial cell) for electroplating a strip 100, with arrows indicating the flow of the electric current.
Figure 5:
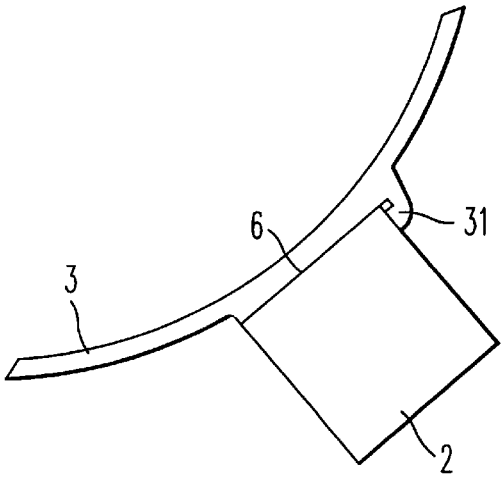
FIG. 5 shows an electrode 3 resting on a support device 2 at an interface 6.
Figure 6:
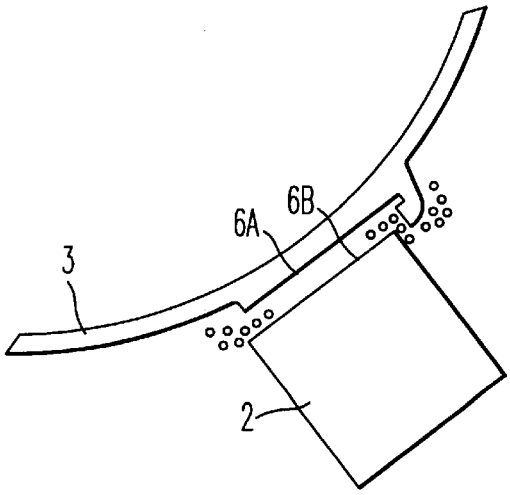
FIG. 6 shows a gap between a resting surface 6A and a contact surface 6B likely to cause an increase in the contact resistance.
Figure 7A:
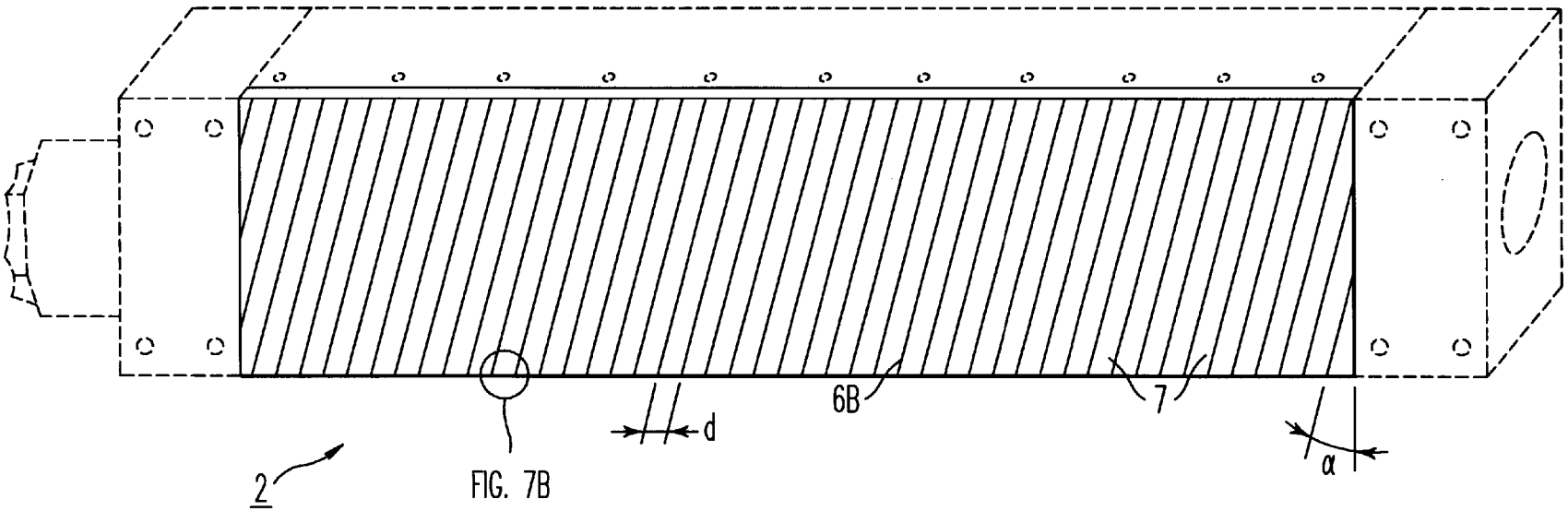
FIG. 7A shows a perspective view of the electrode support device 2 having a grooved resting surface 6B in accordance with the invention.

Referring now to the drawings, and more particularly to FIG. 7A thereof, a support device 2 for an electrode 3 is shown. A contact surface or bearing surface 6B of the support device 2 has grooves 7.

Figure 7B:
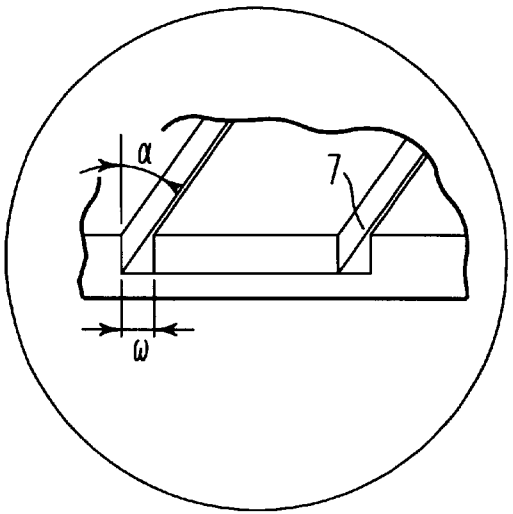
FIG. 7B shows an enlarged view of the circled area A, in FIG. 7A.

FIG. 7B shows the details of the grooves 7 in the contact surface 6B of the support device 2. Preferably, the grooves 7 are not closed, even when the electrodes 3 are resting against the contact surface 6B. Therefore, the grooves 7 open into the electroplating bath 5 when the installation is operating.

Preferably the width and the density of the grooves 7 are suitably adapted such that the total surface area of the grooves 7 does not represent more than 30% of the contact surface 6B. For a rectangular contact surface 6B of 200 cm×50 cm, the grooves 7 may have a width, w, of 0.5 mm and may be spaced apart at intervals, d, of 3 cm. The direction of the grooves 7 preferably makes an acute angle $\alpha$ with the small side of the rectangle of the contact surface 6B.

Figure 8:
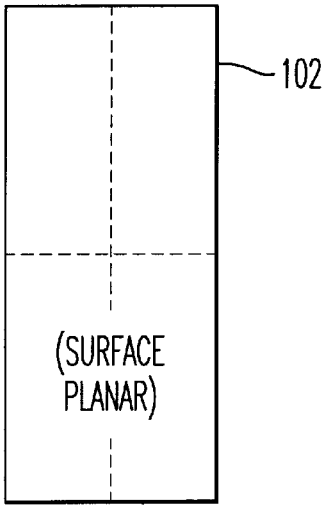
FIG. 8 PRIOR ART
FIG. 8 shows a conventional electrode or support device resting surface 102 having a planar surface.
Figure 9:
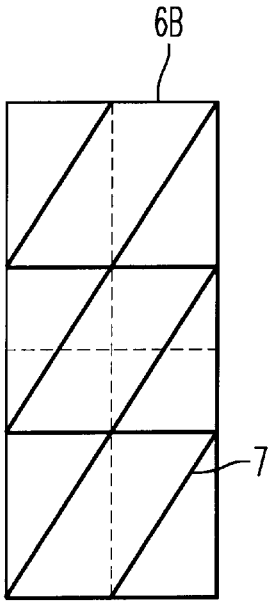
FIGS. 9 through 13 show various embodiments of an electrode resting surface 6B (or, alternatively, a support device resting surface 6A) constructed in accordance with the present invention.
Figure 10:
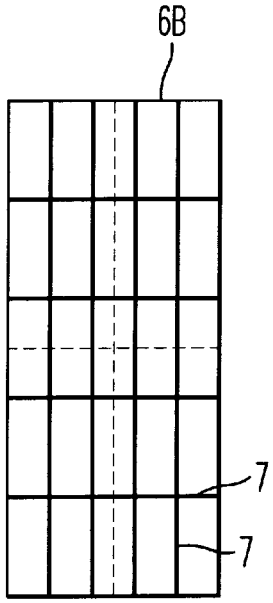
Figure 11:
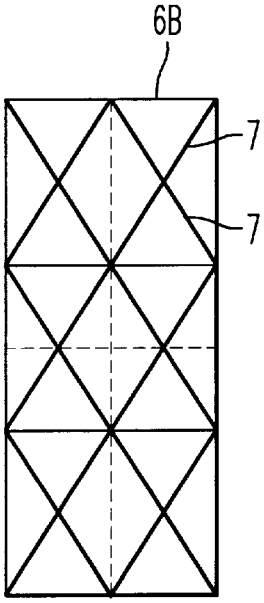
Figure 12:
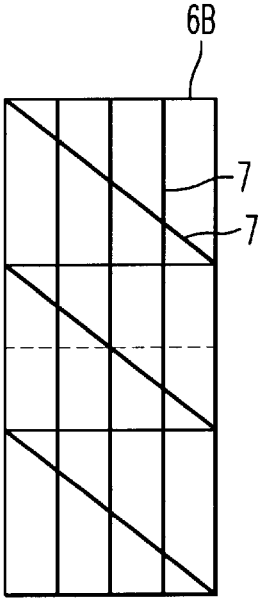
Figure 13:
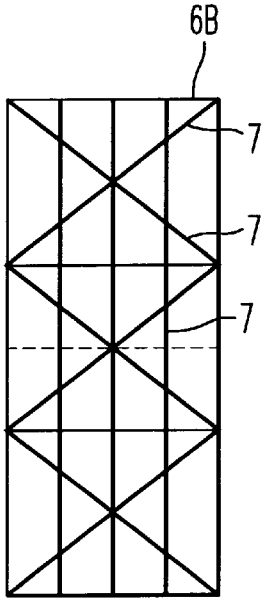

FIGS. 9–13 illustrate various examples of contact surfaces 6B provided with grooves 7 in accordance with the present invention. The grooves 7 in the contact surfaces 6B shown in FIGS. 9–13 contrast with the flat, smooth support surface 102 of the conventional contact surface shown in FIG. 8.

The present invention also includes the formation of grooves 7 on the resting surface 6A of the electrode 3. Accordingly, the surfaces shown in FIGS. 9 through 13 may be resting surfaces 6A of an electrode 3 rather than contact surfaces 6B of a support device 2.

Further, the present invention includes the formation of the interface 6 by the resting surface 6A of the electrodes 3 and/or the bearing surface 6B of the support devices 2, 4 such that grooves 7 provide an opening for the bath 5 to enter the interface 6. Accordingly, the electroplating installation of the present invention includes a support interface 6 having grooves 7 that open into the bath 5.

Counterintuitively, the presence of grooves 7 at the interface 6 increases the real current density at the interface 6 even though the real electrical contact surface is reduced. Further, the contact resistance declines appreciably at a constant resting force of the electrodes 3 against the support device 2. Thus, the grooves 7 made in the support surface 6A, the contact surface 6B, and/or the interface 6 reduce the electrical contact resistance between the electrodes 3 and the support devices 2, 4. Further, electrical losses arising from the electrical contact resistance between the electrodes 3 and the support devices 2, 4 are also reduced, particularly when the current density at the interface 6 exceeds 0.025 A/mm$^2$.

Since heating and gas emission at the interface 6, even at high current densities, are limited by the present invention, the support and electrode contact material is less susceptible to cracking as in the case of graphite-based material used in conventional devices. Accordingly, the present invention allows for the use of graphite-based materials that are much more resistant to wear and greatly improve the useful life of the electrode support devices 2, 4 with little or no drawbacks. The invention therefore makes it possible to increase the useful life of the electrode support devices 2, 4, and also, if necessary, the useful lives of the electrodes 3 themselves.

The present invention is based on French Patent Application No. 97 15 179, filed Dec. 3, 1997, incorporated by reference herein.

Obviously, numerous modifications and variations of the present invention are possible in light of the above teachings. The invention is applicable to all types of electroplating installations where the electrical contacts between the electrodes and their corresponding support devices are submerged in a bath. The present invention may be applied to any variety of plating processes and apparatuses by providing grooves that open the electrical interface to the bath. It is therefore to be understood that within the scope of the appended claims, the invention may be practiced otherwise than as specifically described herein.

What is claimed is:

1. An apparatus for supporting and supplying a current to an electroplating electrode, comprising:

an electrical contact surface on which the electroplating electrode may slide or rest, said electrical contact surface having a plurality of grooves.

2. The apparatus of claim 1, wherein the electrical contact surface is formed primarily of graphite.

3. An electroplating electrode for resting on a support device having an electrical contact surface on which the electroplating electrode may slide and rest, comprising:

a support surface configured to contact the electrical contact surface of the support device, said support surface having a plurality of grooves.

4. The electroplating electrode of claim 3, wherein the electroplating electrode consists essentially of a material selected from the group consisting of: zinc and a zinc alloy.

5. An electroplating installation for coating the conducting surface of a part, comprising:

an electroplating bath;

electrodes submerged in the electroplating bath and resting on at least one support device configured to support the electrodes and to supply current to the electrodes, said electrodes and said at least one support device defining at least one surface interface between a resting surface of each electrode and a contact surface of the at least one support device, said at least one surface interface having a plurality of grooves that open the interface to the electroplating bath;

a holding mechanism configured to hold said part in the electroplating bath facing the electrodes; and a mechanism configured to generate an electrical electroplating current flowing, between the surface of the part and the electrodes via the at least one support device.

6. The installation of claim 5, wherein the contact surface of the at least one support device comprises:

a plurality of grooves that form the plurality of grooves in the interface.

7. The installation of claim 5, wherein the resting surface of each electrode comprises:

a plurality of grooves that form the plurality grooves in the interface.

8. The installation according to claim 5, wherein the electrodes rest freely on the at least one support device.

9. The installation according to claim 5, wherein at said interface, a resting force of the submerged electrodes on the at least one support device is less than 1 Newton per $cm^2$.

10. The installation according to claim 8, wherein at said interface, a resting force of the submerged electrodes on the at least one support device is less than 1 Newton per $cm^2$.

11. The installation according to claim 9, wherein said resting force is less than 0.1 Newton per $cm^2$.

12. The installation according to claim 10, wherein said resting force is less than 0.1 Newton per $cm^2$.

13. The installation of claim 5, further comprising:

means for permitting the electrodes to slide along the support device at the interface during electroplating.

14. The installation of claim 13, further comprising:

means for causing the strip travel through the bath;

wherein the electrodes include bars extending the length of a path of travel in the bath and are grouped in at least one set of electrodes arranged side by side and facing the travel path of the strip;

the said at least one support device is formed by a beam extending transversally to the means for causing the strip to travel through the bath, said beam supporting the corresponding electrodes of the at least one set of electrodes; and the means for permitting the electrodes to slide includes means for permitting the electrodes of the at least one set of electrodes to slide on the corresponding beam.

15. The installation of claim 14, wherein the means for causing the strip to travel through the bath comprises:

a strip carrying roller that is at least partially submerged in the bath;

wherein the electrodes have a curve, the radius of which, is substantially the same as the strip carrying roller such that each of said at least one set of electrodes forms a cylindrical generator portion partially enveloping the strip carrying roller in the bath.

* * * * *